United States Patent [19]

Smith, III

[11] Patent Number: 4,676,144

[45] Date of Patent: Jun. 30, 1987

[54] CLEAN ROOM SYSTEM

[75] Inventor: Allen H. Smith, III, Glenside, Pa.

[73] Assignee: SmithKline Beckman Corporation, Philadelphia, Pa.

[21] Appl. No.: 814,230

[22] Filed: Dec. 30, 1985

[51] Int. Cl.[4] ..... F24F 7/10

[52] U.S. Cl. ..... 98/1.5; 98/31.5; 98/115.3

[58] Field of Search ..... 98/1.5, 31.5, 31.6, 98/33.1, 34.5, 34.6, 115.1, 115.3; 55/385 A, DIG. 18

[56] References Cited

U.S. PATENT DOCUMENTS

| | | | |
|---|---|---|---|
| 2,484,685 | 10/1949 | Burdick et al. | 98/1.5 X |
| 2,633,842 | 4/1953 | Higgs | 55/385 A X |
| 2,710,574 | 6/1955 | Runion | 55/274 |
| 3,509,810 | 5/1970 | Riester | 98/1.5 |
| 3,601,031 | 8/1971 | Abel et al. | 62/261 |
| 4,267,769 | 5/1981 | Davis et al. | 98/31.5 |
| 4,489,645 | 12/1984 | Sirch et al. | 98/34.6 X |

FOREIGN PATENT DOCUMENTS

| | | | |
|---|---|---|---|
| 136041 | 8/1982 | Japan | 98/1.5 |
| 664932 | 1/1952 | United Kingdom | 98/115.3 |

OTHER PUBLICATIONS

Kewaunee Laboratory Fume Hoods, Kewaunee Manufacturing Company, Adrian, Mich., Section 2, 1965, p. 40.

*Primary Examiner*—Harold Joyce

*Attorney, Agent, or Firm*—Finnegan, Henderson, Farabow, Garrett & Dunner

[57] ABSTRACT

A clean room system includes a processing room containing production equipment, a technical room adjacent the processing room and containing machinery for actuating the production equipment, and a wall separating the production equipment from the actuating machinery. The wall also serves to isolate the atmosphere of the processing room from the atmosphere of the technical room and to prevent contaminants emitted by the machinery from entering the processing room and, ultimately, contaminating the goods being manufactured or processed. The clean room system also is provided with a ventilation system for recirculating and filtering the atmosphere of the processing room. The ventilation system maintains the atmosphere of the processing room at a higher pressure than that of the atmosphere of the technical room to prevent air from passing from the technical room into the processing room. The system permits personnel to have access to the machinery actuating the production equipment without having to enter the processing room itself.

13 Claims, 6 Drawing Figures

CLEAN ROOM SYSTEM

BACKGROUND OF THE INVENTION

1. Field of the Invention

The present invention relates to a system for isolating a processing room, or "clean room," from contaminants. More particularly, the invention relates to a clean room system that isolates a processing room from contaminants produced by machinery running the production equipment inside the processing room and that provides access by technical personnel to the machinery without requiring their entrance into the processing room.

2. Description of the Related Art

In conventional clean room systems used, for example, in the pharmaceutical, cosmetic, and electronics industries, production equipment typically is located in the central portion of the processing room. Normally, a conventional clean room system also includes a dedicated ventilation system for filtering and recirculating the atmosphere of the processing room. The ventilation system conventionally includes supply ducts in the ceiling of the processing room and return ducts in the walls near the floor. Normally, HEPA filters having efficiencies greater than 99% in removing particles 0.5 micron or larger are positioned in the ventilation system at the terminal end of the supply ducts. The supply air system supplies HEPA Class 100 or better filtered air to the processing room in a manner that produces laminar flow over the centrally located production equipment to "wash" contaminants from the production equipment, from the personnel operating the production equipment, and from any work pieces used with the production equipment. The laminar air flow normally splits at the centrally located production equipment and is directed around each side of the production equipment.

The personnel operating the production equipment within the processing room take special precautions in removing contaminants from their persons and clothing to avoid bringing the contaminants into the processing room. Conventionally, the processing room is maintained at an atmospheric pressure higher than that of adjacent environments to ensure that any atmospheric leakage is from the processing room rather than into the processing room. It is well known in the art that a clean room can atmospherically isolate a processing room without requiring the processing room to be hermetically sealed from adjacent environments. As long as the atmospheric pressure in the processing room is sufficiently higher than that of adjacent environments, and the cumulative cross-sectional areas of passageways providing atmospheric communication between the processing room and the adjacent environments is sufficiently small, contaminants from adjacent environments will not enter the processing room. Government regulations governing clean room systems used in the pharmaceutical industry, for example, require the processing rooms to be maintained at an atmospheric pressure at least 0.5 inch column of water higher than that of adjacent environments.

Because of the necessity of keeping contaminants from the processing room, clean room systems are particularly costly to construct, maintain, and repair. When technical personnel must have access to the processing room to repair or maintain the production equipment, they must go through the same cleansing procedures followed by the production personnel before entering the processing room. The cleansing procedures apply not only to the technical personnel and their clothes, but also to the tools, replacement parts, and other equipment they must bring into the processing room. Consequently, if a maintenance or repair person discovers, after entering the processing room, that he lacks the proper tool to make the repair, he must leave the processing room and start the cleansing process anew before reentering with the proper tool. Furthermore, because the machinery actuating the processing equipment inside the clean room often must be exposed to accomplish repairs and maintenance, contaminants such as oil, dust, and other particles from the machinery also will be released into the clean room atmosphere by the technical personnel. To limit the contamination from the actuating machinery, the processing line normally must be shut down, the production personnel must leave the clean room to avoid picking up such contaminants, and all work pieces must be removed from the vicinity of the exposed machinery. All of these precautions cause delays and increase the cost of operating a clean room system and, subsequently, the cost of the goods being manufactured or processed.

Similar problems exist in industries that process hazardous materials such as munitions, atomic fuel, toxic chemicals, and atomic waste. Hazardous material processing systems conventionally isolate the production personnel from the production equipment by the use of special suits that are in atmospheric communication with an adjacent room but are isolated from the processing room containing the hazardous material production equipment. When the production equipment must be repaired or maintained, the processing room must be cleared of all hazardous material to enable the technical personnel to enter the room and work on the production equipment.

The present invention is intended to provide an improved clean room system that provides technical personnel with access to the machinery actuating the production equipment inside a clean processing room without requiring them to enter the processing room itself.

The present invention also is intended to provide a clean room system that isolates a clean processing room from contaminants emitted by the machinery operating the production equipment inside the processing room while the production machinery is being operated as well as during maintenance.

Furthermore, the present invention is intended to provide a system for isolating the atmosphere of a hazardous material processing room from machinery that actuates the production equipment in the processing room and provides access by technical personnel to the machinery without requiring them to enter the hazardous processing room.

Additional advantages of the present invention will be set forth in part in the description that follows and in part will be obvious from that description or can be learned by practice of the invention. The advantages of the invention can be realized and obtained by the system particularly pointed out in the appended claims.

SUMMARY OF THE INVENTION

The present invention overcomes the problems of the prior art clean room systems by providing a system including a wall that separates the processing room from an adjacent technical room and that separates the production equipment within the processing room from the machinery that actuates the production equipment.

To overcome the problems of the prior art clean room systems and in accordance with the purpose of the invention, as embodied and broadly described herein, the clean room system of this invention comprises a processing room containing production equipment, a technical room adjacent the processing room and containing machinery for actuating the production equipment, linkage means for connecting the production equipment to the actuating machinery, and wall means for separating the production equipment from the actuating machinery and for isolating the atmosphere of the processing room from the atmosphere of the technical room. The linkage means passes through the wall means, which prevents contaminants emitted by the machinery from entering the processing room. The clean room system of this invention also comprises ventilation means for recirculating and filtering the atmosphere of the processing room.

Broadly, the present invention further includes means for maintaining the atmosphere of the processing room at a pressure at least 0.5 inch column of water higher than the pressure of the atmosphere of the technical room, and the wall means includes openings permitting passage of the linkage means through the wall means to connect the production equipment and the machinery. The openings are sized to prevent air from passing from the technical room into the processing room. Preferably, the wall means of the clean room system is removable and includes window means for permitting visual communication between the processing room and the technical room.

The present invention also provides a hazardous material isolating system comprising a hazardous material processing room containing production equipment, a technical room adjacent the processing room and containing machinery for actuating the production equipment, linkage means for connecting the production equipment to the actuating machinery, and wall means for separating the production equipment from the actuating machinery and for isolating the atmosphere of the processing room from the atmosphere of the technical room. The linkage means passes through the wall means. The hazardous material isolating system of this invention also comprises ventilation means for recirculating and filtering the atmosphere of the processing room. The ventilation means includes means for maintaining the atmosphere of the processing room at a lower pressure than the atmosphere of the technical room.

The accompanying drawings, which are incorporated in and which constitute a part of this specification, illustrate one embodiment of the invention and, together with the description, explain the principles of the invention.

DESCRIPTION OF THE PEFERRED EMBODIMENTS

Reference now will be made in detail to the presently preferred embodiments of the invention, examples of which are illustrated in the accompanying drawings.

Figure 1:
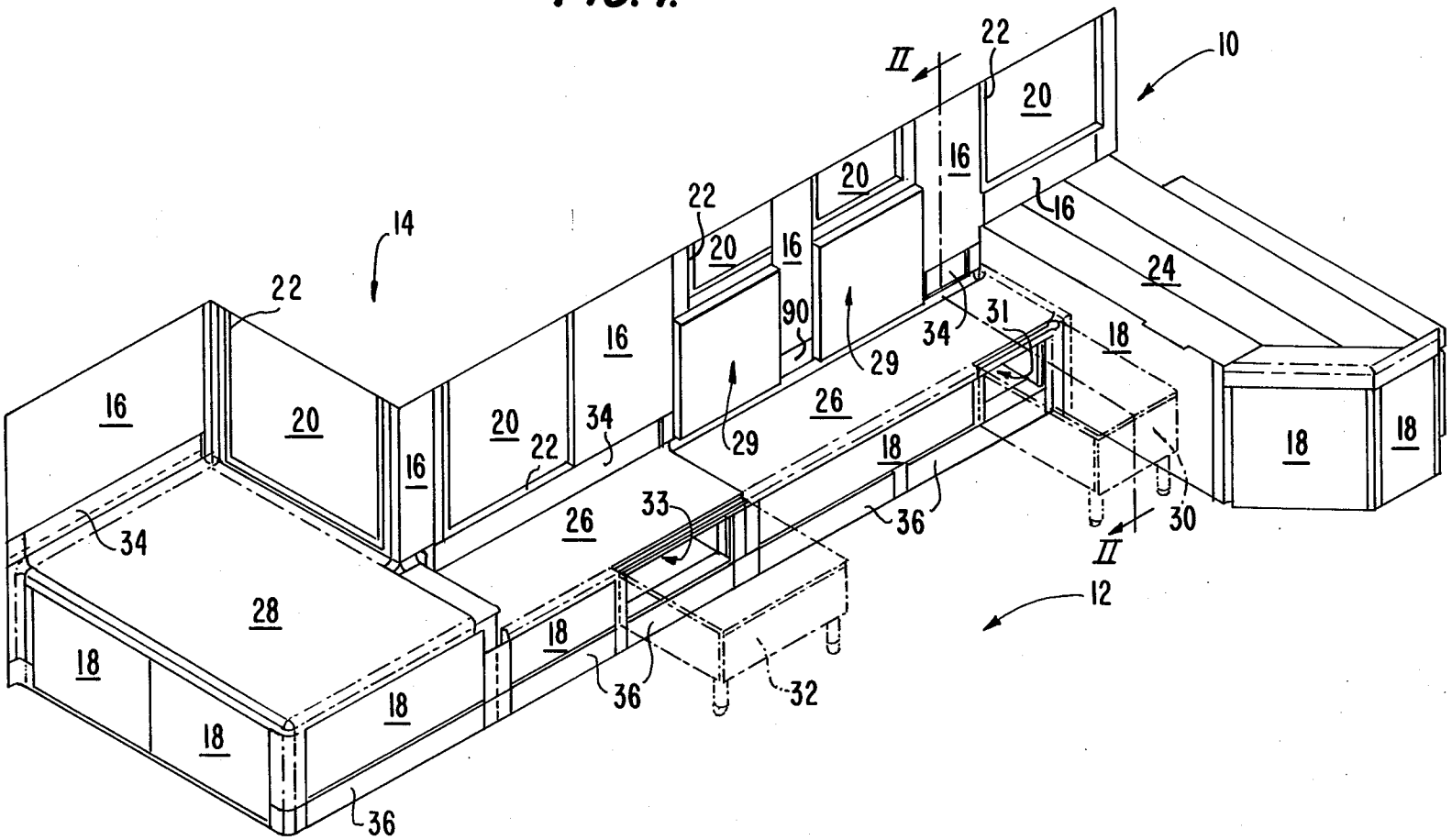
FIG. 1 is a perspective view of one embodiment of the wall means of the present invention.
Figure 2:
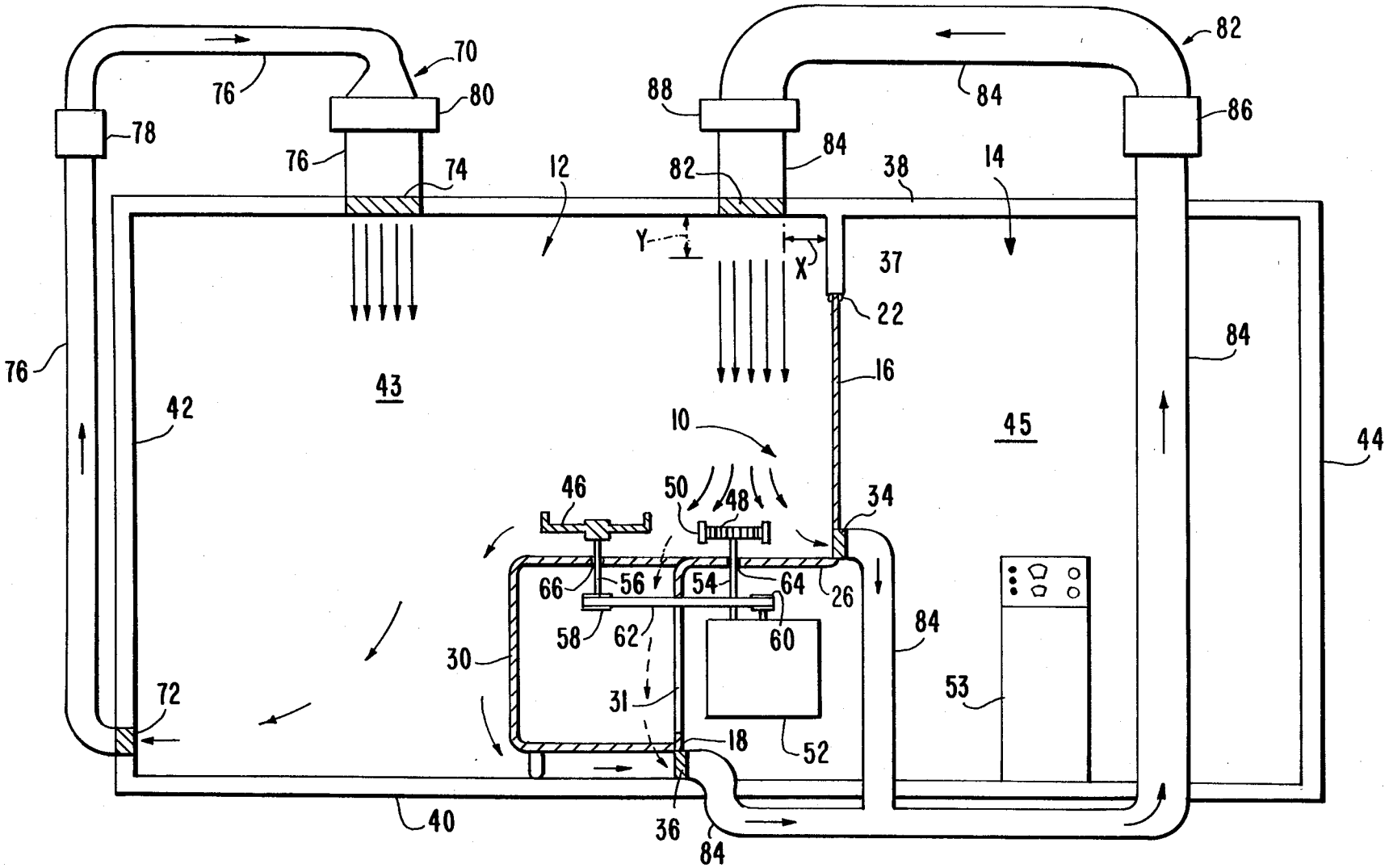
FIG. 2 is a schematic sectional view of the clean room system of the present invention taken along lines II—II of FIG. 1.

FIGS. 1 and 2 show the clean room system of the present invention as it is applied to an vial-filling production line for use in the pharmaceutical industry. The clean room system shown is equally applicable to a production line for filling other containers, such as bottles, ampules, cartridges, and cassettes. FIG. 1 is a perspective view showing wall portion 10, which separates processing room 12 from technical room 14. Processing room 12 contains production equipment (some of which is shown in FIG. 2) for conveying the vials, filling them with the correct amount of pharmaceutical material, sealing the vials with stoppers, and loading the stoppered vials onto trays. The machinery for actuating the production equipment in processing room 12 is located on the opposite side of wall portion 10 in technical room 14. Wall portion 10 provides means for separating the production equipment from the actuating machinery and for isolating the atmosphere of the processing room from the atmosphere of the technical room.

As seen in FIG. 1, wall portion 10 includes upper vertical wall members 16, lower vertical wall members 18, window members 20, and horizontal wall members 24, 26, 28. These wall members provide a barrier against atmospheric communication between processing room 12 and technical room 14 to prevent contamination of the atmosphere of processing room 12 by the atmosphere of or materials in technical room 14. Wall members 16, 18, 24, 26, 28 preferably are made of stainless steel or some other inert material that will not promote adherence of contaminant particles. Window members 20 preferably are connected to upper vertical wall members 16 by gaskets 22 made of rubber or other suitable material to prevent air from passing around the edges of the panes of window members 20. Other barriers to atmospheric communication between processing room 12 and technical room 14 include filler pump backing plates 29, on which are mounted the pumping equipment that fills the vials, vial infeed disk module 30, and stopper feeder bowl module 32. Modules 30 and 32 are substantially air-tight machinery housing, the interiors of which are in atmospheric communication with technical room 14 through openings 31 and 33, respectively. Also shown in FIG. 1 are upper return grills 34 and lower return grills 36, which are part of the ventilation system for processing room 12 to be described later. Preferably, horizontal wall member 24 is a roller conveying table that operates as an additional return air grill. Wall portion 10 preferably is removable to permit easy access to the production equipment and actuating machinery during, for example, periodic overhauls, and to facilitate installation and future modifications.

The operation of the clean room system of this invention now will be explained with reference to FIG. 2, which shows a section of wall portion 10 installed between processing room 12 and technical room 14. In the embodiment shown in FIG. 2, wall portion 10 is installed between lintel 37, which projects downwardly from ceiling 38, and floor 40. Lintel 37 provides structural support for ceiling 38 when wall portion 10 is removed. Alternatively, ceiling 38 can be constructed to be self-supporting without a lintel. In such a case, wall portion 10 would extend from floor 40 to ceiling 38. In the embodiment of FIG. 2, processing room 12 is enclosed by wall portion 10 and lintel 37, ceiling 38, floor 40, left side wall 42, rear wall 43, and a wall (not shown) opposite rear wall 43. Technical room 14 is enclosed by wall portion 10 and lintel 37, ceiling 38, floor 40, right side wall 44, rear wall 45, and a wall (not shown) opposite rear wall 45.

Processing room 12 contains production machinery used for handling and filling vials (not shown). FIG. 2 shows vial infeed disk 46, which rotates along a vertical axis to supply vials in a single file for filling after they have converged off of the roller conveying table, and conveyor drive disk 48, which is rotatable about a vertical axis for driving vial conveyor belt 50.

The machinery for actuating vial infeed disk 46, conveyor drive disk 48, and other production equipment contained within processing room 12 is located within technical room 14 and actuates the production equipment in processing room 12 through linkage means for connecting the production equipment to the actuating machinery. In the embodiment shown in FIG. 2, the actuating machinery includes motor 52, which rotates vial infeed disk 46 and conveyor drive disk 48. As embodied in FIG. 2, linkage means includes shaft 54 connecting conveyor drive disk 48 to motor 52 and shaft 56 connecting vial infeed disk 46 to motor 52 through pulleys 58, 60 and belt 62. Horizontal wall member 26 and the top surface of vial infeed disk module 30 are provided, respectively, with openings 64 and 66, which respectively permit passage of shafts 54 and 56 through wall portion 10 to connect the production equipment in processing room 12 with the actuating machinery in technical room 14.

Despite the existence of openings in wall portion 10 that permit atmospheric communication between processing room 12 and technical room 14, wall portion 10 provides means for isolating the atmosphere of the processing room from the atmosphere of the technical room because the ventilation system for processing room 12, to be described below, maintains processing room 12 at an atmospheric pressure higher than that of technical room 14 so that any leakage that does occur between the adjacent processing room and technical room is from processing room 12 to technical room 14. Of course, the openings in wall portion 10 should be sized to minimize the loss of air from processing room 12 to technical room 14 and to maintain the pressure differential between processing room 12 and technical room 14.

The clean room system of the present invention also includes ventilation means for recirculating and filtering the atmosphere of processing room 12. In the embodiment illustrated in FIG. 2, the ventilation means includes two separate recirculation loops, both of which are dedicated to processing room 12. First recirculation loop 70 includes intake grill 72, which passes through left side wall 42 near floor 40 and is connected to supply grill 74 in ceiling 38 by air conduit 76. The air is recirculated by pump 78 and is filtered by HEPA filter 80, which preferably is 99.999% efficient in removing particles 0.5 micron and larger in diameter.

Second recirculation loop 82 includes upper return grills 34 located at the junction between upper vertical wall member 16 and horizontal wall members 24, 26, 28 of wall portion 10, and lower return grills 36, which are located at the juncton of lower vertical wall members 18 and floor 40. Air supply grill 82 in ceiling 38 is connected to return grills 34, 36 by conduit 84, which preferably passes up through the central portion of technical room 14. The air is recirculated through conduit 84 by pump 86, and contaminants are removed from the recirculated air by HEPA filter 88, which also preferably is 99.999% efficient in removing particles 0.5 micron and larger in diameter.

The configuration of the ventilation means shown in FIG. 2 is merely illustrative of one possible embodiment. Other embodiments, such as a single-loop system, one using substantially the entire surface of ceiling 38 within processing room 12 as an air supply grill, or one using structural grating to form floor 40 so that the entire floor 40 acts as a load-bearing return air grill, may be used.

The arrows in FIG. 2 illustrate the air flow pattern produced by the ventilation means. As is well known in the art, the recirculated air supplied to the processing room of a clean room system should exhibit laminar flow in the vicinity of the production equipment, production personnel, and work pieces in order to "wash" any contaminants out of the processing room and route them through the filtered ventilation system. In the embodiment illustrated in FIG. 2, it is particularly important that the air flow remains laminar in the vicinity immediately above horizontal wall members 24, 26, 28 because the vials are conveyed along and parallel to the horizontal wall members during the filling operation.

Although wall portion 10 provides means for separating the production equipment from the actuating machinery and for isolating the atmosphere of processing room 12 from the atmosphere of technical room 14, it creates an obstacle to the desired laminar air flow in the vicinity of the vial filling line. By locating upper return ducts 34 on one side of the vial filling line and lower return ducts 36 at the floor level below the filling line, the clean room system of the present invention produces laminar air flow that splits and remains laminar in the region above horizontal wall member 26 to wash the vials being conveyed along conveyor belt 50. Preferably, conveyor belt 50 is positioned above horizontal wall members 26 by a minimum distance of approximately twelve inches to ensure that any turbulance that occurs along the boundary layer of horizontal wall member 26 occurs downstream of the vials. By employing a roller conveying table as horizontal wall member 24, the embodiment of the pesent invention shown in FIGS. 1 and 2 employs horizontal wall member 24 as a return air grill, and the air flow remains laminar as it passes around the vials, down between the rollers, and directly into the ventilation system via a connection (not shown) with conduit 84.

Positioning the production line adjacent the vertical wall formed by lintel 37, window members 20, and upper vertical wall members 16 also interferes with the desired laminar flow if supply grill 82 is located too close to the vertical wall, so that friction between the supply air flow and the vertical surface of wall portion 10 produces turbulance. I have found that, by maintaining a minimum distance x between the vertical surface of wall portion 10 that is within processing room 12 and the edge of return grill 82 closest to wall portion 10, where x is approximately six inches, turbulance is eliminated at a distance y of approximately thirty-six inches below return grill 82.

As stated above, the atmospheric pressure of processing room 12 is maintained at a higher level than the atmospheric pressure of technical room 14, U.S. Government Good Manufacturing Regulations requiring at least a 0.5 inch column of water difference in the pharmaceutical industry. The measured difference in air pressure, however, is in ambient air pressure so that the actual, active pressure differential produced by the ventilation system normally is higher than 0.5 inch column of water. Thus, openings 64, 66, for example, can be relied upon to provide one-way atmospheric communication from processing room 12 into technical room 14 because the ventilation system produces an effective pressure differential higher than the ambient differential. Accordingly, openings between processing room 12 and technical room 14 can be larger than would be expected if only the ambient pressure differential were relied upon to isolate the atmosphere of processing room 12. For example, an opening approximately five inches by eight inches covered by hinged door 90 (see FIG. 1) can be provided in wall portion 10 to permit removal of glass scrap and sealing fragments that accumulate in an ampule filling line. With conventional clean room systems, scrap is accumulated in the processing room until the end of a work shift, when it is then removed from the processing room through an air lock.

Although the present invention has been described with reference to an vial filling line, the present invention can be used in any application that requires an atmospheric environment with a limited amount of particulates and other contaminants. The invention is applicable, for example, to semiconductor and microprocessor circuit production in the electronics industry, medical testing facilities, scientific research facilities, and pharmaceutical processing.

Figure 3:
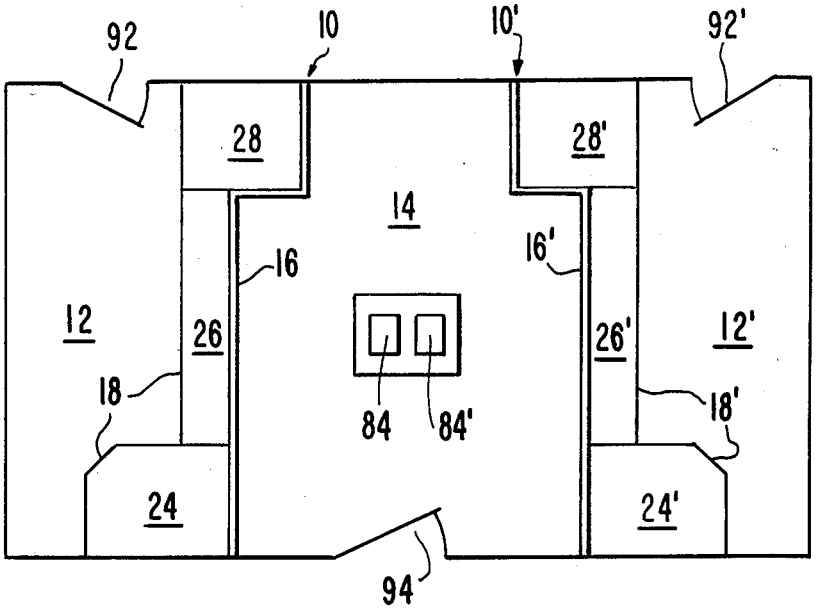
FIG. 3 is a plan view of an embodiment of the clean room system of the present invention permitting access to the machinery actuating production equipment in two processing rooms from a single technical room.

Moreover, although the present invention has been described with reference to a single processing room horizontally adjacent to a single technical room, other configurations are within the scope of this invention. For example, FIG. 3 is a plan view showing a clean room system in which two processing rooms 12, 12' are separated by a single technical room 14 that provides access to the machinery of both processing rooms. Wall portion 10', which isolates processing room 12' from technical room 14, is a mirror image of wall portion 10 and includes vertical wall members 16', 18', and horizontal wall members 24', 26', 28'. The atmosphere of processing room 12' is recirculated via conduit 84', which passes up through technical room 14 adjacent conduit 84, which is connected to processing room 12. The configuration of FIG. 3 allows further isolation of the processing room environments from the technical room environments by providing doors 92 and 92' permitting entrance to processing room 12 and 12', respectively, on the opposite side of the clean room system from doorway 94, which provides access to technical room 14.

Figure 4A:
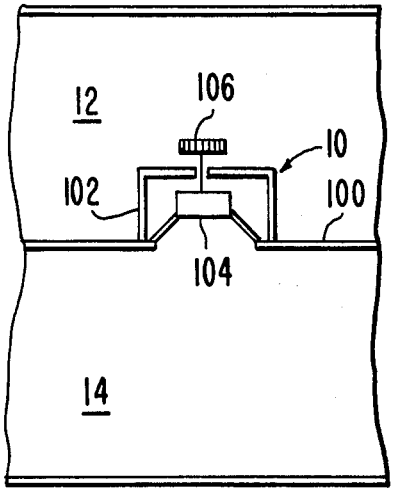
FIGS. 4(*a*) and 4(*b*) are schematic sectional views of clean room systems in accordance with the present invention, where the processing room and technical room are vertically adjacent.
Figure 4B:
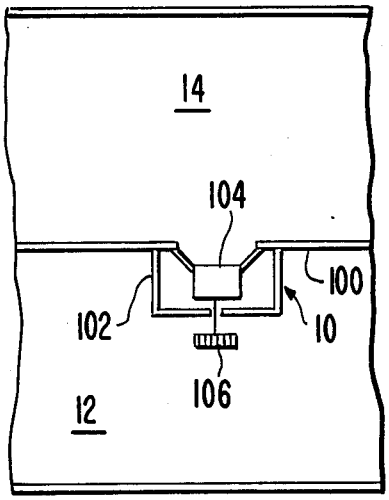

The present invention also is not limited to horizontally juxtaposed rooms. As shown in FIGS. 4(*a*) and 4(*b*), processing room 12 and technical room 14 can be vertically adjacent. FIG. 4(*a*) shows a clean room system wherein processing room 12 is above technical room 14, and wall portion 10 comprises ceiling/floor 100 and machinery cover 102, which separate the actuating machinery (schematically designated by reference numeral 104) from production equipment 106. Maintenance personnel have access to machinery 104 through the opening in floor/ceiling 100 without having to enter processing room 12. FIG. 4(*b*) shows an alternative clean room system wherein processing room 12 is above technical room 14, maintenance personnel having access to machinery 104 from above.

Figure 5:
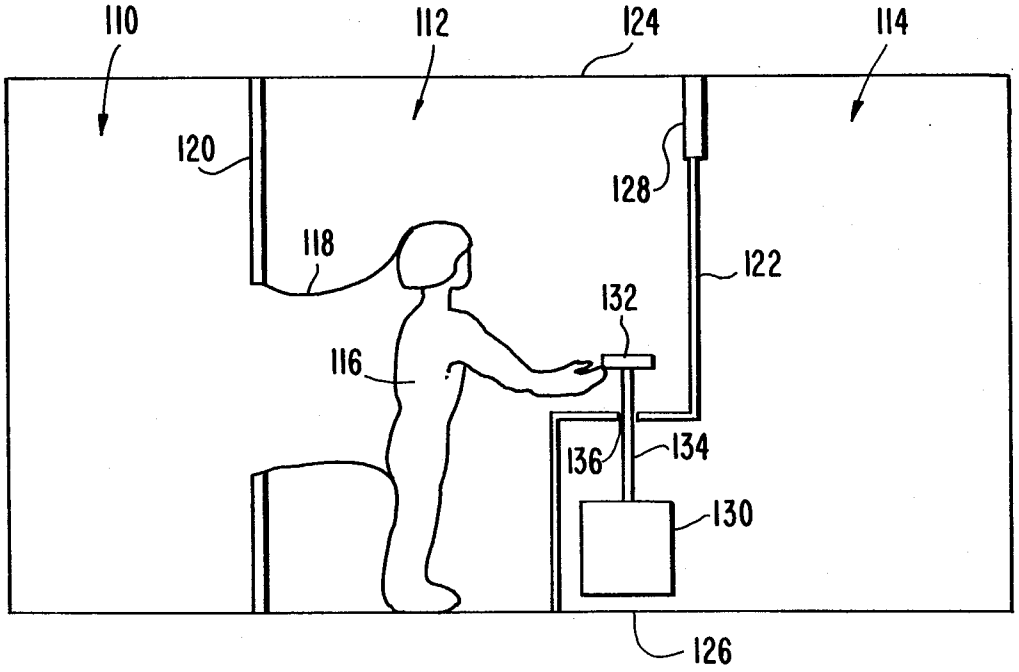
FIG. 5 is a schematic sectional view of the clean room system of the present invention applied to a hazardous material processing system.

As shown in FIG. 5, the clean room system of the present invention also has applications in the hazardous material industry. FIG. 5 shows three adjacent rooms, personnel access room 110, processing room 112, and technical room 114. The operator, designated by reference numeral 116, is physically within processing room 112 but is isolated from the atmosphere of processing room 112 by air-impermeable membrane 118 or some other isolating means that is connected to wall 120, which separates access room 110 from processing room 112. In conventional hazardous material processing systems, the machinery actuating the production equipment within processing room 112 is accessible to technical personnel for repair and maintenance only if they physically enter processing room 112. The conventional configuration requires the hazardous material production line to be halted and the processing room cleansed of hazardous materials before permitting maintenance personnel to enter and work on the machinery.

The present invention, when applied to a hazardous material processing system, includes technical room 114 separated from processing room 112 by wall portion 122, which can extend from ceiling 124 to floor 126 or can, as shown in FIG. 5, extend from floor 126 to lintel 128 extending down from ceiling 124. The embodiment shown in FIG. 5 is similar to the clean room system shown in FIG. 2 and includes, for example, motor 130, which is located in technical room 114 and rotates conveyor drive disk 132 located within processing room 112 via shaft 134. Shaft 134 passes through opening 136 in wall portion 122 to connect motor 130 to drive disk 132. As with the clean room system of FIG. 2, processing room 112 of the hazardous material processing system of FIG. 5 has a dedicated closed-loop ventilation system (not shown).

In contrast to the clean room system previously described, the ventilation means of the hazardous material processing system maintains the atmospheric pressure of processing room 112 at a lower level than that of technical room 114. Consequently, any atmospheric communication betwen processing room 112 and technical room 114 is from technical room 114 to processing room 112, and technical personnel can maintain and repair the actuating machinery within technical room 114 without being exposed to the hazardous materials within processing room 112. In a configuration shown in FIG. 5, opening 136 normally provides a close fit around shaft 134 to minimize the possibility of hazardous materials entering technical room 114.

The system of this invention, whether used in place of conventional clean room systems or in a hazardous material processing application, provides many advantages over conventional systems. Down time and its attendant costs are reduced because repairs and maintenance can be performed by technical personnel in the technical room without requiring the production personnel in the processing room to halt the line and leave. Maintenance and repair can be performed more efficiently because technical personnel need not undergo special preparation and gowning before obtaining access to the machinery, and response time to maintenance calls is improved. In addition, the technical personnel in the technical room can get immediate feedback from the production personnel in the processing room instead of having to wait until the processing line is restarted before discovering whether certain adjusments to the machinery were correct. Further advantages include decreased conjestion and enhanced security with the reduction of traffic within the processing room. Better product quality and reduced employee health and safety problems also should result. Moreover, because the system of this invention relocates the processing equipment adjacent a wall, the size of the processing rooms can be reduced relative to conventional processing rooms having centrally located production lines. Reducing processing room size would decrease the initial construction cost of a clean room system, because the processing room tends to be more expensive per unit area than rooms where reduced contamination is less critical. Furthermore, smaller processing rooms require lower capacity HVAC and support systems, thus entailing lower initial construction costs and continued operating costs.

It will be apparent to those skilled in the art that other modifications and variations can be made in the clean room system of this invention. The invention in its broader aspects, therefore, is not limited to the specific details and illustrated examples shown and described. Accordingly, departure can be made from such details without departing from the spirit of applicant's general inventive concept.

I claim:

1. A clean room system, comprising:

a. a processing room containing production equipment adapted to be used by production personnel located within said processing room;

b. a technical room adjacent said processing room and containing machinery for actuating said production equipment;

c. linkage means for connecting said production equipment to said actuating machinery;

d. wall means for separating said production equipment from said actuating machinery and for isolating the atmosphere of said processing room from the atmosphere of said technical room, said wall means preventing contaminants emitted by said machinery from entering said processing room and said linkage means passing through said wall means; and e. ventilation means for recirculating and filtering the atmosphere of said processing room.

2. The clean room system of claim 1, wherein said production equipment is mounted on said wall means.

3. The clean room system of claim 1, wherein said ventilation means includes means for maintaining the atmosphere of said processing room at a pressure higher than the pressure of the atmosphere of said technical room.

4. The clean room system of claim 3, wherein said wall means includes openings permitting passage of said linkage means through said wall means to connect said production equipment and said machinery, and wherein said pressure of said processing room is sufficiently higher than said pessure of said technical room to prevent air from passing from said technical room into said processing room through said openings.

5. The clean room system of claim 3, wherein said pressure of said processing room exceeds said pressure of said technical room by at least 0.5 inch column of water.

6. The clean room system of claim 1, wherein said wall means includes window means for permitting visual communication between said processing room and said technical room.

7. The clean room system of claim 1, wherein said wall means is removable.

8. The clean room system of claim 1, wherein said processing room is positioned above said technical room.

9. The clean room system of claim 1, wherein said processing room is positioned below said technical room.

10. The clean room system of claim 1, wherein said ventilation means includes means for providing laminar air flow within said processing room.

11. A clean room system, comprising:

a. a processing room containing production equipment adapted to be used by production personnel located within said processing room;

b. a technical room adjacent said processing room and containing machinery for actuating said production equipment;

c. linkage means for connecting said production equipment to said actuating machinery;

d. wall means for separating said production equipment from said actuating machinery and for isolating the atmosphere of said processing room from the atmosphere of said technical room, said wall means preventing contaminants emitted by said machinery from entering said processing room and said linkage means passing through said wall means; and e. ventilation means for recirculating and filtering the atmosphere of said processing room, for producing laminar air flow in said processing room, and for maintaining the atmosphere of said processing room at a pressure higher than the pressure of the atmosphere of said technical room.

12. A clean room system, comprising:

a. first and second processing rooms, each containing production equipment adapted to be used by production personnel located within said respective processing room;

b. a technical room adjacent and between said first and second processing rooms, said technical room containg machinery for actuating said production equipment in each of said processing rooms;

c. wall means for separating said production equipment from said actuating machinery and for isolating the atmosphere of each of said processing rooms from the atmosphere of said technical room, said wall means preventing contaminants emitted by said machinery from entering said processing rooms; and d. ventilation means for recirculating and filtering the atmosphere of each of said processing rooms.

13. A hazardous material isolating system, comprising:

a. a hazardous material processing room containing production equipment adapted to be used by production personnel located within said processing room;

b. a technical room adjacent said processing room and containing machinery for actuating said production equipment;

c. linkage means for connecting said production equipment to said actuating machinery;

d. wall means for separating said production equipment from said actuating machinery and for isolating the atmosphere of said processing room from the atmosphere of said technical room, said linkage means passing through said wall means; and e. ventilation means for recirculating and filtering the atmosphere of said processing room, said ventilation means including means for maintaining the atmosphere of said processing room at a lower pressure than the atmosphere of said technical room.

* * * * *